US005781095A

United States Patent [19]

Dietsch et al.

[11] Patent Number: 5,781,095

[45] Date of Patent: Jul. 14, 1998

[54] BLOWN FUSE INDICATOR FOR ELECTRICAL FUSE

[75] Inventors: G. Todd Dietsch, Park Ridge; Joseph W. Kowalik, Skokie; Heraclio R. Gomez, Northbrook; Cesar T. Herbias, Calumet City, all of Ill.

[73] Assignee: Littelfuse, Inc., Des Plaines, Ill.

[21] Appl. No.: 842,964

[22] Filed: Apr. 25, 1997

[51] Int. Cl.[6] ..... H01H 85/30

[52] U.S. Cl. ..... 337/243; 337/142; 337/241; 337/401

[58] Field of Search ..... 337/142, 227, 337/228, 241, 242, 243, 401

[56] References Cited

U.S. PATENT DOCUMENTS

| | | | |
|---|---|---|---|
| 1,857,019 | 5/1932 | Hassell et al. . | |
| 3,596,218 | 7/1971 | Layton . | |
| 3,729,607 | 4/1973 | Ellenberger . | |
| 4,445,106 | 4/1984 | Shah . | |
| 4,636,765 | 1/1987 | Shah . | |
| 4,760,367 | 7/1988 | Williams | 337/241 |
| 5,111,177 | 5/1992 | Krueger et al. . | |
| 5,345,210 | 9/1994 | Swenson et al. . | |

FOREIGN PATENT DOCUMENTS

| | | |
|---|---|---|
| 494 202 B1 | 9/1990 | European Pat. Off. . |
| 497988 | 4/1930 | Germany . |
| 27 22 008 A1 | 11/1978 | Germany . |
| 690 26 386T2 | 8/1996 | Germany . |

*Primary Examiner*—Leo P. Picard
*Assistant Examiner*—Jayprakash N. Gandhi
*Attorney, Agent, or Firm*—Wallenstein & Wagner, Ltd.

[57] ABSTRACT

A blown fuse indicator, having an insulating element, a current-carrying element overlaying the insulating element, and a substantially transparent window. A chemical composition coats at least a portion of the insulating element. The improvement comprises a meltable link in generally parallel proximity to the insulating element. The meltable link, which can be made of solder, melts to open an indicating circuit of the blown fuse indicator upon predetermined thermal overload conditions.

11 Claims, 1 Drawing Sheet

BLOWN FUSE INDICATOR FOR ELECTRICAL FUSE

DESCRIPTION

1. Technical Field

The invention relates to a blown fuse indicator for an electrical fuse.

2. Background of the Invention

Electrical fuses for protecting electrical circuits are well-known in the art. Such fuses may protect large or small voltage applications. Fuses that are used to protect electrical circuits associated with motors and other large voltage electrical applications are commonly known in the art as "power fuses."

Power fuses manufactured by Littelfuse, Inc., the assignee of the present application, have included an indicator circuit that is separate from the main circuit through which current travels. When the main circuit opens, a window that is a part of that indicator circuit is darkened by the deposition of an evaporating chemical. This darkening provides a visual indication that the fuse has blown.

The prior art power fuses described above are known as the Littelfuse IDSR Indicator™ fuses, and are generally similar to the present invention. Particularly, those prior art power fuses include, in the second circuit parallel with the main circuit through the fuse, an insulating element; a current-carrying element overlaying the insulating element; and a chemical composition which coats at least a portion of the insulating element.

These prior art power fuses provide excellent service and results. It has been found under certain conditions, however, that the clear plastic window of these fuses will melt. Although this melting is not a known safety hazard, it is, nevertheless, a concern.

The melting occurs when there is a low voltage or high impedance condition upon opening of the main fuse assembly. If these conditions exist, and if the main fusible link of the power fuse has already opened, all of the current through the fuse passes through the second parallel element, which comprises the blown fuse indicator.

The prior art fuse is designed so that after opening of the main assembly, current passes through the parallel indicator assembly causing the chemical which surrounds the insulating element to vaporize and coat the window of the blown fuse indicator with a dark coating. Shortly after or concurrently with this deposition, the current-carrying element of the indicator device is designed to open. Under certain low voltage or high impedance conditions, the current-carrying element will not open. If this element does not open, a small amount of current will continue to flow through the indicator circuit.

This on-going current flow, if continued for an adequate time, results in the generation of considerable heat. The temperature resulting from this heat will reach a point where it will melt the clear plastic window of the prior art fuses.

The present invention is a modification to the design of the prior indicator device which solves this problem.

SUMMARY OF THE INVENTION

The invention is a blown fuse indicator comprising an insulating element, a current-carrying element overlaying the insulating element, and a substantially transparent window. A chemical composition coats at least a portion of the insulating element. The improvement comprises a meltable link in generally parallel proximity to the insulating element. The meltable link, which can be made of solder, melts to open the blown fuse indicator circuit upon predetermined temperature conditions.

Preferably, the current-carrying element is a wire which is spirally-wound around an insulating element, which comprises a ceramic core. The preferred current-carrying element is made of a copper-nickel alloy. To prevent the meltable link from contacting the current-carrying element, there is a barrier between the meltable link and the current-carrying element.

The preferred chemical composition for coating the ceramic core 14 is a blend of fluorescein, calcium sulfate, polyurethane, and paint thinner. This chemical composition vaporizes to coat the substantially transparent window under overcurrent conditions.

Other features and advantages of the invention will be apparent from the following specification taken in conjunction with the following drawings.

DETAILED DESCRIPTION OF THE PREFERRED EMBODIMENT

Figure 1:
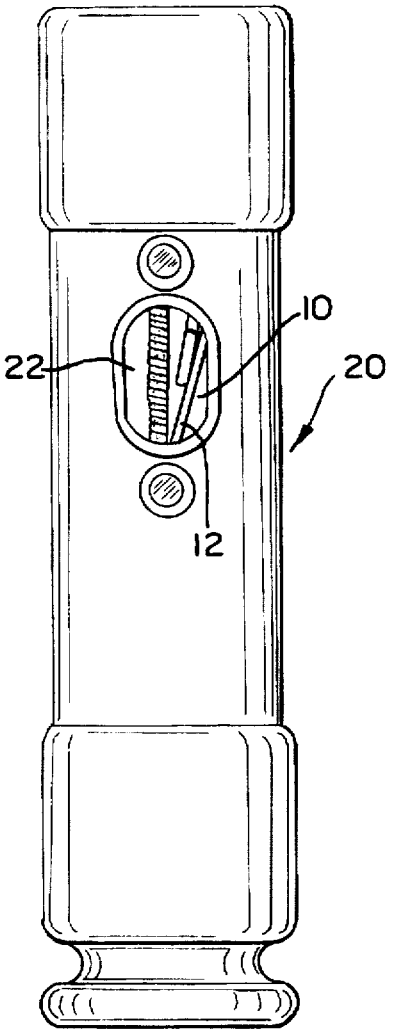
FIG. 1 is a front view of a fuse containing the blown fuse indicator in accordance with the invention, with that fuse indicator showing the fuse in a normal condition.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
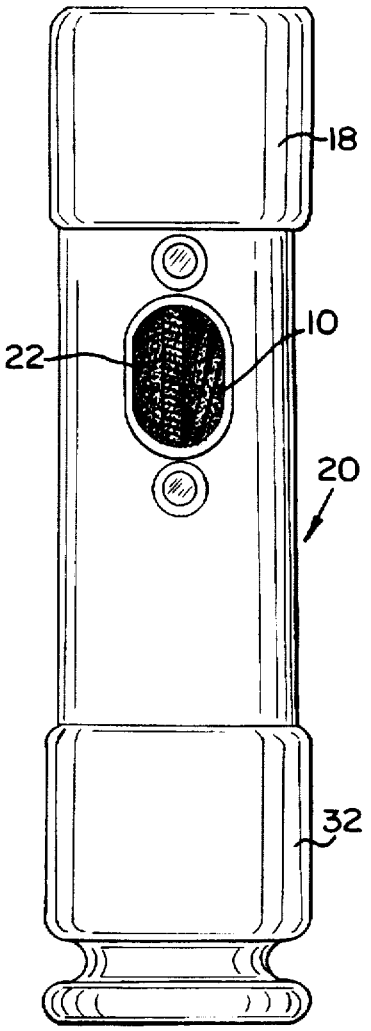
FIG. 2 is a front view of the fuse of FIG. 1, also containing the blown fuse indicator in accordance with the invention, but with the window of that fuse indicator being darkened and, thus, showing the fuse in a blown condition.
Figure 3:
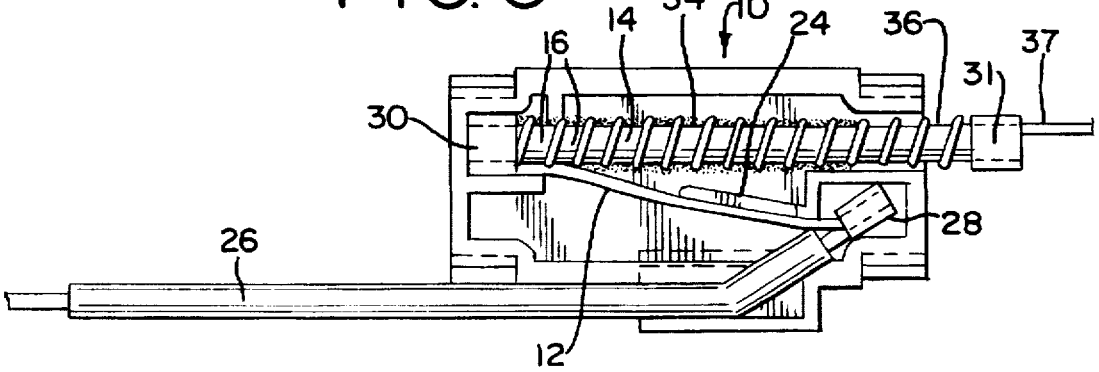
FIG. 3 is a top view of the blown fuse indicator that is normally contained within the fuse of FIGS. 1 and 2, but disassembled from and withdrawn from that fuse.

The present invention is shown in FIGS. 1–3. Although the invention is not limited to any particular fuse or field of use, one of the primary fields of use for which it is intended is with so-called power fuses, such as the Indicator™ line of fuses manufactured by Littelfuse, Inc., the assignee of the present application.

Such prior art fuses include two parallel circuits. The first circuit is of a lower resistance than the second circuit, and comprises the main fusible link control circuit through which the current normally passes. Such fuses and their fusible links are shown in U.S. Pat. No. 5,345,210, issued on Sep. 6, 1994. The fusible link is best shown in isolation in FIG. 5 of the '210 patent. Not shown in this patent is a prior art indicator circuit which is separate from and parallel to the main circuit through which current travels.

The indicator circuit, which is used in fuses like that shown in FIG. 5 of the '210 patent, includes an opaque plastic piece, and a clear plastic piece sealed to the opaque plastic piece, the clear plastic piece forming a window. Together, these two plastic pieces form an oval-shaped housing. A wire passes through this housing and is coated with a chemical. Upon overcurrent conditions, the chemical vaporizes and is deposited upon the window. The chemical released during these designated overcurrent conditions darkens the window to indicate a fault condition in the fuse, i.e., a blown fuse.

The prior art Littelfuse IDSR power fuses described above are generally similar to the present invention, and provide excellent service and results. It has been found under certain conditions, however, that the transparent plastic window of these fuses will melt. This melting, while not a known safety hazard, is at least a cosmetic concern.

The melting occurs when there is a low voltage or high impedance condition upon opening of the main fuse assembly. If these conditions exist, and if the main fusible link of the power fuse has already opened, the current through the fuse all passes through the second parallel element, which includes a window for a visual indication of a blown fuse.

The second parallel element of the present invention is substantially identical to that of the prior art, with one important difference. The present sub-element is shown in FIGS. 1–3, and is a blown fuse indicator 10. The important difference is a meltable link 12, such as a solder link, as a component of the invention. Yet another difference is that in the present invention, the chemical composition utilized is made of different components than the chemical used in the prior art fuses.

As may best be seen in FIG. 3, this particular embodiment of the invention comprises an insulating element 14, and a current-carrying element 16 overlaying the insulating element 14.

The insulating element 14 is a ceramic "yarn" manufactured by the Minnesota Mining and Manufacturing Co. ("3M") under Catalog No. NDP 3236. The ceramic is essentially of a cylindrical shape and has a diameter of about 0.050 inches.

The current-carrying element 16 may be a wire that is made of a copper or copper alloy material. One suitable copper alloy material is known as Cupron, and is available from the Jelliff Corporation. Cupron alloy wire has a composition of approximately 45% nickel and 55% copper. One type of Cupron alloy wire suitable for the present invention has a diameter of 0.0014 inches. As may be seen from FIG. 3, the wire 16 extends to the end of the insulating element 14 where it is secured with a splice 31 to one end of a lead wire 37. This lead wire 37 is connected to and terminates at a point not shown in the drawings, i.e., at the inside of the cup-shaped top terminal 18 of the fuse 20.

A chemical composition 34 coats at least a portion of the insulating element, and may optionally cover a portion of the current-carrying element. The chemical composition 34 is represented in FIG. 3 by the darkened regions between adjacent turns of the spirally-wound wire 16.

The chemical composition 34 preferred for the present invention is a combination of four components. The first component is fluorescein, which is manufactured by Sigma Aldrich under Catalog No. F 2456. The second component is calcium sulfate, known as "Snow White," sold by Santell Chemical Corporation. The third component is a liquid, clear polyurethane coating, such as the polyurethane coating that can be applied to hardwood floors. Such a polyurethane coating can be purchased in the paint or coatings department of any hardware store. The fourth component is a paint thinner, which also can be obtained at any hardware store.

To make this chemical composition, 140 grams of fluorescein are blended with 68 grams of calcium sulfate, 4 fluid ounces of polyurethane, and 24 fluid ounces of paint thinner. This chemical composition 34 is placed over the insulating element 14 by dipping that insulating element 14 into the chemical composition 34.

It is preferable to dip the insulating element 14 into the chemical composition prior to placing the current-carrying element 16 over the insulating element 14. If the wire 16 were placed over the core 14, and then the wire 16/core 14 "composite" were dipped in the chemical 34, some of that chemical 34 would adhere to the wire 16. As a result, electrical connections, for example those between wire 16 and the meltable link 12, could be somewhat less effective unless the ends of the wire 16 were cleaned after the dipping operation.

As noted above, the improvement comprises a meltable link 12 in generally parallel proximity to the insulating element 14. As also noted above, the prior art indicators did not include this solder link 12. Instead, the current through the indicator 10 was interrupted when the current-carrying element 16 would break. A problem arose, in that in certain instances the current-carrying element 16 would not break, current would continue to flow through the circuit, and the resultant heat would melt the window, such as window 22. Placing the meltable link 12 in generally parallel proximity to the insulating element 14 ensures that the link 12 is sufficiently close to the insulating element 14 such that the heat generated by the current-carrying element 16 will melt the link 12 and thereby open the circuit.

The term "generally parallel" in this specification is not intended to mean that the meltable link 12 must, in fact, be parallel to the insulating element 14. For example, as may be seen in FIG. 3, the objects of the invention can be accomplished even when the meltable link 12 is close to, but at an acute angle from, the insulating element 14. Such a configuration, or any other configuration which brings the meltable link 12 in close proximity to the insulating element, shall be deemed a "generally parallel" configuration for the purposes of this invention.

The meltable link 12, which can be made of solder, melts to open the circuit of the blown fuse indicator 10 upon predetermined temperature conditions.

As may best be seen in FIGS. 1 and 3, the current-carrying element 16 is preferably a wire which is spirally-wound around the insulating element 14, with spacings between those spiral windings.

It was discovered that if the meltable link 12 began to melt and then contacted a portion of the current-carrying element 16, the current path could be re-established. Thus, such contact could prevent the present invention from accomplishing its intended purpose. To prevent the meltable link 12 from contacting the current-carrying element 16, there is a barrier 24 between the meltable link 12 and the insulating element 14. This barrier 24 may be made of the same plastic material as the housing of the blown fuse indicator 10. As may best be seen in FIG. 3, the barrier 24 has an elongated flat shape and contacts the meltable link 12 along much of its length.

The blown fuse indicator 10 also includes a stranded insulated wire 26 which completes the electrical circuit between the ends 18 and 32 of the fuse 20. The stranded insulated wire 26 is secured with a splice 28 to one end of the meltable link 12. The other end of the meltable link 12 is secured with a splice 30 to one end of the wire 16. The far end of the insulated wire 26 (not shown) is secured to the inside of the cup-shaped bottom terminal 32 of the fuse 20.

In normal operation, as shown in FIG. 1, current flowing through the fuse 20 passes mainly through the lower resistance, main fusible link, as depicted in the '210 patent. When that main fusible link opens, the current passes through the parallel circuit, including the blown fuse indicator 10. Under most circumstances, the wire 16 opens quickly and the heat causes the chemical composition 34 to vaporize instantaneously, coating the window 22 with a dark chemical residue. This dark coating, as depicted in FIG. 2, provides a visual indication that the fuse 20 has blown.

As stated above, however, there are certain conditions under which the wire 16 will not open quickly. Under these conditions, with prior art blown fuse indicators, current can continue to pass through the blown fuse indicator 10, heating the oval-shaped housing and perhaps melting its window 22. This is avoided in the present invention, where the heat within the housing is sufficient to melt the meltable link 12. When the meltable link 12 melts, the circuit through the blown fuse indicator 10 is interrupted, even though the wire 16 has not opened.

It has been discovered that the blown fuse indicator of FIG. 3 can be modified for use with larger or smaller voltage fuses. The blown fuse indicator 10 of FIG. 3 includes a portion 36 of the insulating element 14/current-carrying element 16 "composite" that extends beyond the housing. The mere lengthening of this "composite" structure facilitates use of the blown fuse indicator 10 in higher voltage applications.

As may be seen in FIG. 3, the portion of the insulating element 14/current-carrying element 16 "composite" structure which extends beyond the window 22 does not need to be chemically coated. This is because the function of the chemical coating is merely to vaporize, and thereby coat and provide a blown fuse indication on the window 22. To the extent that the chemical would not coat the window 22, i.e., to the extent that the chemical is beyond the perimeter of the window 22, the chemical would serve no known purpose.

Although this embodiment shows spacing between the spiral windings of the wire 16, it should be understood by those skilled in the art that the windings can be very closely spaced.

While the specific embodiment has been illustrated and described, numerous modifications come to mind without significantly departing from the spirit of the invention, and the scope of protection is only limited by the scope of the accompanying claims.

What we claim is:

1. A blown fuse indicator, comprising:

a. an insulating element;

b. a current-carrying element overlaying said insulating element;

c. a transparent window;

d. a chemical composition, said chemical composition coating at least a portion of said insulating element; and e. a meltable link in generally parallel proximity to said insulating element;

said meltable link melting to open a circuit of said blown fuse indicator upon predetermined temperature conditions.

2. The blown fuse indicator of claim 1, wherein said current-carrying element is spirally-wound around said insulating element.

3. The blown fuse indicator of claim 1, wherein said insulating element is a ceramic core.

4. The blown fuse indicator of claim 1, wherein said current-carrying element is made of a copper-nickel alloy.

5. The blown fuse indicator of claim 1, further comprising a barrier between said meltable link and said insulating element to prevent said meltable link from contacting said insulating element.

6. The blown fuse indicator of claim 1, wherein said chemical composition is comprised of fluorescein.

7. The blown fuse indicator of claim 1, wherein said chemical composition is comprised of fluorescein and calcium sulfate.

8. The blown fuse indicator of claim 1, wherein said portion of said insulating element which is coated with said chemical composition is substantially within said window.

9. A blown fuse indicator, comprising:

a. an insulating element comprised of a ceramic core;

b. a current-carrying element spirally-wound around said insulating element;

c. a substantially transparent window;

d. a chemical composition, said chemical composition coating at least a portion of said insulating element;

e. a meltable link in generally parallel proximity to said insulating element; and f. a barrier between said meltable link and said insulating element to prevent said meltable link from contacting said current-carrying element;

said meltable link melting to open the circuit of said blown fuse indicator upon predetermined temperature conditions.

10. The blown fuse indicator of claim 9, wherein said current-carrying element is made of a copper-nickel alloy.

11. A blown fuse indicator, comprising:

a. an insulating element;

b. a current-carrying element overlaying said insulating element;

c. a transparent window;

d. a chemical composition, said chemical composition coating at least a portion of said current-carrying element; and e. a meltable link in generally parallel proximity to said insulating element;

said meltable link melting to open a circuit of said blown fuse indicator upon predetermined temperature conditions.

* * * * *